US007909749B2

(12) United States Patent
Sheedy

(10) Patent No.: US 7,909,749 B2
(45) Date of Patent: Mar. 22, 2011

(54) BOXING DEVICE AND RELATED METHODS

(76) Inventor: Richard Sheedy, Ponte Vedra, FL (US)

( * ) Notice: Subject to any disclaimer, the term of this patent is extended or adjusted under 35 U.S.C. 154(b) by 0 days.

(21) Appl. No.: 11/837,771

(22) Filed: Aug. 13, 2007

(65) Prior Publication Data

US 2009/0048069 A1 Feb. 19, 2009

(51) Int. Cl.

| | |
|---|---|
| ***A63B 23/00*** | (2006.01) |
| ***A63B 71/00*** | (2006.01) |
| ***A63B 69/34*** | (2006.01) |
| ***A63B 69/32*** | (2006.01) |

(52) U.S. Cl. ..... 482/148; 482/83; 482/84; 482/8

(58) Field of Classification Search ..... 482/8–9, 482/83–90, 148

See application file for complete search history.

(56) References Cited

U.S. PATENT DOCUMENTS

| | | | | |
|---|---|---|---|---|
| 482,623 | A * | 9/1892 | Dooling | 73/379.04 |
| 3,933,354 | A | 1/1976 | Goldfarb et al. | 273/1 E |
| 4,088,315 | A | 5/1978 | Schemmel | 272/76 |
| 4,099,714 | A * | 7/1978 | Willis | 463/47.1 |
| 4,340,234 | A * | 7/1982 | Ise | 279/3 |
| 4,401,303 | A * | 8/1983 | Anderson et al. | 482/4 |
| 4,440,400 | A * | 4/1984 | Neuberger | 473/426 |
| 4,534,557 | A * | 8/1985 | Bigelow et al. | 473/442 |
| 4,818,234 | A | 4/1989 | Redington et al. | 434/247 |
| 4,940,228 | A * | 7/1990 | Horvath et al. | 482/84 |
| 4,974,833 | A | 12/1990 | Hartman et al. | 272/76 |
| 5,221,243 | A | 6/1993 | Walker | 482/83 |
| 5,503,606 | A * | 4/1996 | Stephens | 482/7 |
| 5,605,336 | A | 2/1997 | Gaoiran et al. | 273/445 |
| 5,716,302 | A | 2/1998 | Andersson | 482/84 |
| 5,723,786 | A * | 3/1998 | Klapman | 73/379.04 |
| 5,741,970 | A * | 4/1998 | Rubin | 73/379.05 |
| 5,803,877 | A | 9/1998 | Franey | 482/83 |
| 5,836,853 | A * | 11/1998 | Marciano | 482/12 |
| 5,899,809 | A | 5/1999 | Landa Cosio | 463/8 |
| 6,110,079 | A * | 8/2000 | Luedke et al. | 482/83 |
| 6,162,123 | A * | 12/2000 | Woolston | 463/37 |
| 6,464,622 | B1 | 10/2002 | Clark | 482/84 |
| 6,508,747 | B1 | 1/2003 | Cook | 482/83 |
| 6,872,172 | B2 * | 3/2005 | Wang et al. | 482/83 |
| 7,041,039 | B2 * | 5/2006 | Wang et al. | 482/87 |
| 7,063,647 | B2 * | 6/2006 | Harney et al. | 482/54 |
| 7,331,227 | B2 * | 2/2008 | Kang et al. | 73/379.01 |
| 7,353,137 | B2 * | 4/2008 | Vock et al. | 702/173 |
| 7,384,380 | B2 * | 6/2008 | Reinbold et al. | 482/91 |
| 2002/0098946 | A1 | 7/2002 | Clark | 482/1 |
| 2003/0216228 | A1 * | 11/2003 | Rast | 482/84 |

(Continued)

FOREIGN PATENT DOCUMENTS

| | | |
|---|---|---|
| GB | 2249033 | 4/1992 |

*Primary Examiner* — Loan Thanh
*Assistant Examiner* — Robert F Long
(74) *Attorney, Agent, or Firm* — Allen, Dyer, Doppelt, Milbrath & Gilchrist, P.A.

(57) ABSTRACT

A boxing device may include a substrate, at least one impact sensor carried by the substrate for detecting impacts from the at least one user, a user input device for receiving personal characteristic data for the at least one user, and a controller coupled to the impact sensor and the user input device. The controller may be for determining performance data based upon detected impacts, and weighting the performance data based upon the personal characteristic of the at least one user.

10 Claims, 6 Drawing Sheets

U.S. PATENT DOCUMENTS

2004/0009851 A1 1/2004 Lovison ..... 482/84
2004/0110605 A1* 6/2004 Wang et al. ..... 482/83
2005/0085298 A1* 4/2005 Woolston ..... 463/37
2005/0181913 A1* 8/2005 Vang et al. ..... 482/83
2005/0192165 A1* 9/2005 Booker ..... 482/84
2005/0209066 A1* 9/2005 Penney ..... 482/84
2005/0250625 A1* 11/2005 Reinbold et al. ..... 482/84
2005/0266967 A1* 12/2005 Considine et al. ..... 482/84
2006/0166793 A1* 7/2006 Gobel et al. ..... 482/87
2006/0247106 A1* 11/2006 Peavey ..... 482/83
2006/0252608 A1* 11/2006 Kang et al. ..... 482/84
2006/0258515 A1* 11/2006 Kang et al. ..... 482/83
2007/0123389 A1* 5/2007 Martin ..... 482/8
2007/0142178 A1* 6/2007 Harney et al. ..... 482/8
2007/0213182 A1* 9/2007 Anderson ..... 482/83
2008/0225041 A1* 9/2008 El Dokor et al. ..... 345/419
2010/0130329 A1* 5/2010 Sullivan et al. ..... 482/4

* cited by examiner

BOXING DEVICE AND RELATED METHODS

FIELD OF THE INVENTION

The present invention generally relates to sports equipment/games and, more particularly, to boxing training/exercise devices and related methods.

BACKGROUND OF THE INVENTION

Boxing has long been a popular sport, and there are many training devices for amateur and professional boxers. By way of example, some prior art references disclose punching bags or dummy/mannequin targets with sensors for detecting impact speed, intensity, etc., and providing a score based thereon. One example is U.S. Pat. No. 6,464,622 to Clark, which is directed to a punching bag (i.e., a speed bag) with electronic sensors for counting the number of hits to a particular zone on the bag, and with different exercise programs for a user.

Great Britain Patent No. 2,249,033 to Albasri discloses a full or partial dummy shaped target with a resilient body section, a foam material filler, and transducers positioned at various locations on the body section for detecting punches/kicks. The transducers may also be placed in clothes that are positioned on the dummy target.

U.S. Pat. Pub. No. 2003/0216228 to Rast is directed to an apparatus for providing biofeedback for sports training to improve training in a convenient form. One aspect is directed to include a sparring device that converts impact and training rates into audio streams following human speech patterns.

U.S. Pat. No. 3,933,354 to Goldfarb et al. discloses a reflex testing amusement apparatus that allows simulated head-to-head sparring and scoring. The picture of each combatant camouflages a series of lights, with each light being located at a key attack/defense point on the combatant's body. At the start, one of the lights is turned on and the participants each try to hit their light to turn it off. The first "hit" causes both first lights to extinguish and a second light in each series to illuminate. The player to make the first "hit" gets a scoring credit for that "hit." The participants strike at the second light and so on as the lights are sequenced in a pseudo-random order. The game continues for a predetermined period and at the end a winner is determined by comparing the number of "hits" made by the players. Modifications for a single-player game and a game which runs until a predetermined score is made are also provided.

Other references such as U.S. Pat. App. No. 2004/0009851 to Lovison and U.S. Pat. No. 6,508,747 to Cook disclose sparring gear with sensors for detecting impacts that allow opponents to score points for kicks/punches to one another that hit the designated scoring zones. These references also both teach wireless radio frequency (RF) links from the sensor to a scoring controller.

Despite the existence of such equipment, further improvements in boxing training or exercise devices/games may be desired in various applications.

SUMMARY OF THE INVENTION

In view of the foregoing background, it is therefore an object of the present invention to provide a boxing device with enhanced performance data features and related methods.

This and other objects, features and advantages are provided by a boxing device which may include a substrate, at least one impact sensor carried by the substrate for detecting impacts from at least one user, and a user input device for receiving personal characteristic data for the at least one user. Furthermore, a controller may be coupled to the impact sensor and the user input device for determining performance data based upon detected impacts, and weighting the performance data based upon the personal characteristic of the at least one user.

The boxing device may be utilized by more than one user with at least one impact sensor or set of sensors for each user, and the controller may weight individual user performance data based upon respective personal characteristics of the users. Further, the personal characteristic data provided through the user input device may include age data, weight data or other data, for example.

Additionally, the boxing device may include at least one visual strike indicator carried by the substrate adjacent to at least one impact sensor and coupled to the controller, and the controller may cause the at least one visual strike indicator to provide a visual indication for queuing a user to strike the at least one impact sensor. In certain embodiments, the substrate may comprise a punching bag, while in other embodiments the substrate may comprise a cover removably positioned on a punching bag.

Furthermore, performance data may be based upon the number of calories expended by the at least one player, the number of impacts to the at least one impact sensor, etc. The at least one impact sensor may measure an impact force level and use the impact force level to determine the performance data.

Performance data may be provided to the user or users through an audio output device or a visual display coupled to the controller, for example. Additionally, the impact sensor(s) may be positioned on the substrate for receiving punches and/or kicks from the at least one user.

A multi-user boxing device and associated methods are also provided.

DETAILED DESCRIPTION OF THE PREFERRED EMBODIMENTS

The present description is made with reference to the accompanying drawings, in which preferred embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime notation is used to indicate similar elements in alternative embodiments.

Figure 1:
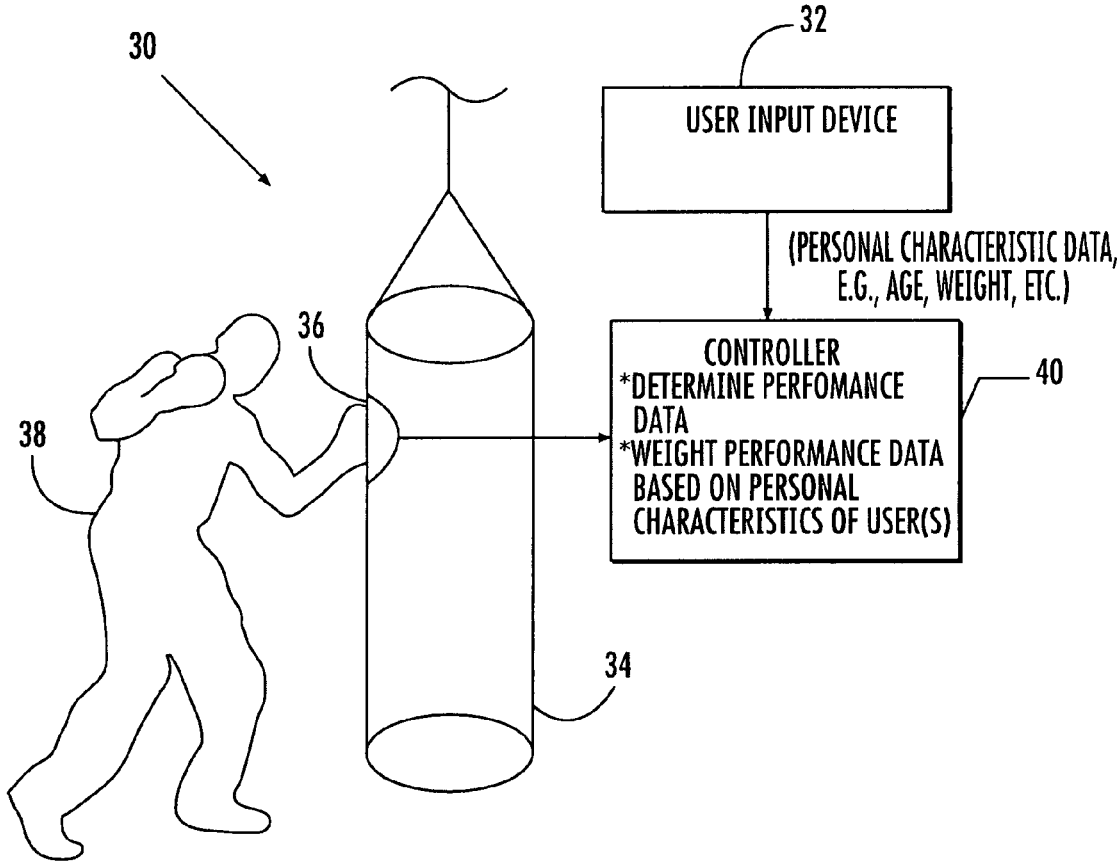
FIG. 1 is a schematic diagram of a boxing device in accordance with the present invention.

Referring initially to FIG. 1, a boxing device 30 in accordance with one aspect is first described. The boxing device 30 illustratively includes a substrate 34, which in the illustrated example is a heavy bag, which carries an impact sensor(s) 36.

The system 30 also illustratively includes a user input device 32 and a controller 40. The impact sensor 36 detects impacts from a user 38 which are communicated to the controller 40. More particularly, the impact sensor(s) 36 may be connected to the controller 40 by a wired and/or wireless communications link, as will be appreciated by those skilled in the art.

The user input device 32 allows one or more users 38 or other individuals to input personal characteristics such as age, weight or other data into the boxing device 30. The controller 40 receives the personal characteristic data from the user input device 32 and the impact data from the impact sensor 36, and determines performance data that is weighted for the individual user 38 based upon the personal characteristic data, as will be discussed further below.

The performance data may, for example, include a number of calories consumed or "burned" during the boxing training/exercise session or other types of physiological data relating to the benefits obtained during the boxing session. The performance data may also be a score determined by the number of impacts received by the impact sensor(s) 36, force, speed and/or accuracy of impact, comparison of impact from punches and kicks, comparison of the current session to previous boxing sessions, and/or other data. In a multi-user mode, the performance data may involve a comparison of two or more users to score user performance as if they were in an actual boxing match.

While "Heavy bag", "punching bag" and/or "bag" are used to describe the substrate 34, it should be understood that the substrate may take other forms than the heavy punching bag depicted in FIGS. 1, 2 and 4, such as a floor-to-ceiling punching bag, a speed bag, "mannequin" style punching dummies, etc. Other objects/shapes are also possible. The punching bag or other substrate 34 may be attached to a wall, may stand freely on a base, may hang from the ceiling, or be mounted in other ways, as will be appreciated by those skilled in the art. If the substrate 34 is suspended from the ceiling, it may have a "spin hold" feature that prevents the bag or other substrate from spinning. The spin hold feature encourages footwork and provides the user 38 with a better opportunity to land accurate punches and kicks on the impact sensor(s) 36. A stabilizing bar may also be used to keep the punching bag facing the user 38, as will be appreciated by those skilled in the art.

Figure 2A:
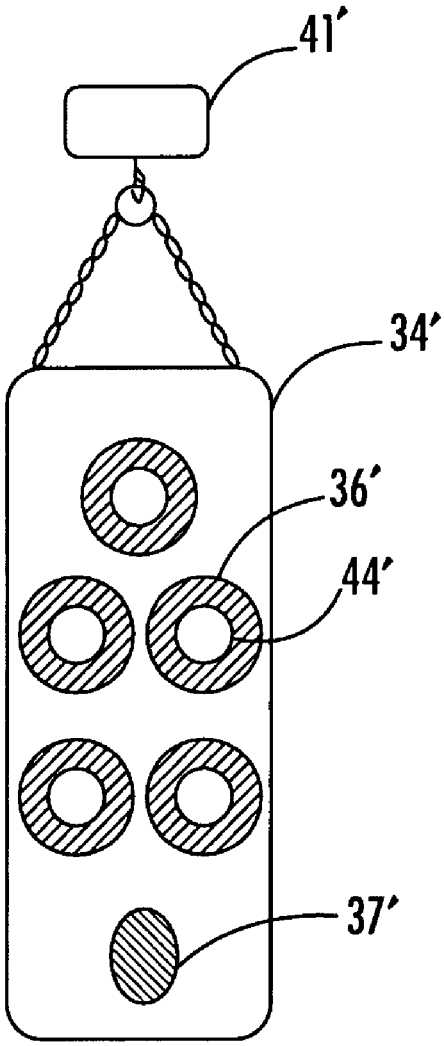
FIGS. 2A and 2B are front and rear views of an alternative embodiment of the substrate and controller of the boxing device of FIG. 1.
Figure 2B:
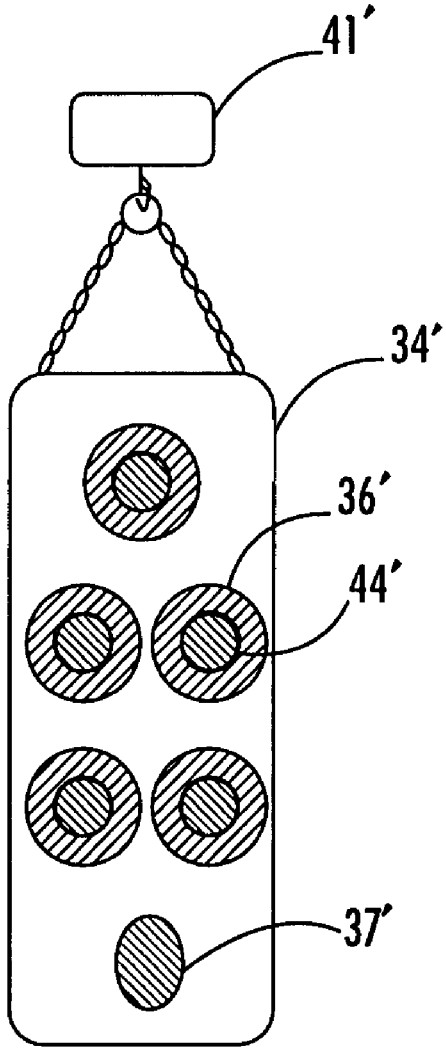

Turning now to FIGS. 2A and 2B, the controller 40 may be embodied in a housing 41' from which the substrate 34' hangs. This advantageously allows the user to see the controller housing 41' during a training/exercise session. In the alternative, the controller 40 and/or housing may be remotely located from the substrate 34' and communicate with the impact sensor 36' through wireless communication, such as radio frequency ("RF") or other wireless communication techniques, as noted above.

FIG. 2A shows the front side of a substrate 34' (i.e., heavy bag) with impact sensors 36' carried by the substrate. The impact sensors 36' shown are circular but could be different sizes or shapes, as will be appreciated by those skilled in the art. The impact sensors 36' located on the upper portion of the substrate 34' may be used for punching, while the lower impact sensors may be used for kicking or other contact using the lower body, for example.

The impact sensor 36' may, but is not required to, have a precision impact sensor 44', shown as a circle within the outer impact sensor circle to detect more precise impacts. Where the precision impact sensor 44' is used, impacts occurring in the inner precision impact sensor 44' circle may be scored as more precise impacts, while impacts received primarily or entirely in the outer circle impact sensor 36' may be scored as less precise impacts. In another embodiment, impacts on the precision impact sensor 44' may be scored as landed punches, while contact with the outer impact sensor 36 may be scored as punches thrown but not landed. Other sensors for detecting impacts may also be provided outside of the impact sensor 36 area designated to receive impacts, allowing the boxing system to track missed or blocked punches, as will be understood by those skilled in the art.

FIG. 2B shows the impact sensors 36' and precision impact sensors 44' that are carried on the back side of the substrate 34'. The back side sensors may be used for multi-user 38 boxing sessions, or simply to allow a single users, to move around the bag and strike different targets to more closely approximate an actual boxing match and/or enhance the cardiovascular workout, for example. The impact sensor 36' and precision impact sensor 44' shown in FIG. 2B are smaller than those shown in FIG. 2A to illustrate that the size of the impact sensors 36' may be made smaller to provide more challenge for more skilled users or made larger for less skilled users, for example. Different colors for impact sensors 36' may be used to distinguish the front from the back side of a substrate 34', as well as markings or other indicia. The impact sensors 36' may have different color spots for upper and lower target areas, and may also use a different color for a "low blow" impact sensor 37' indicating an area that should not receive impacts.

Figure 3A:
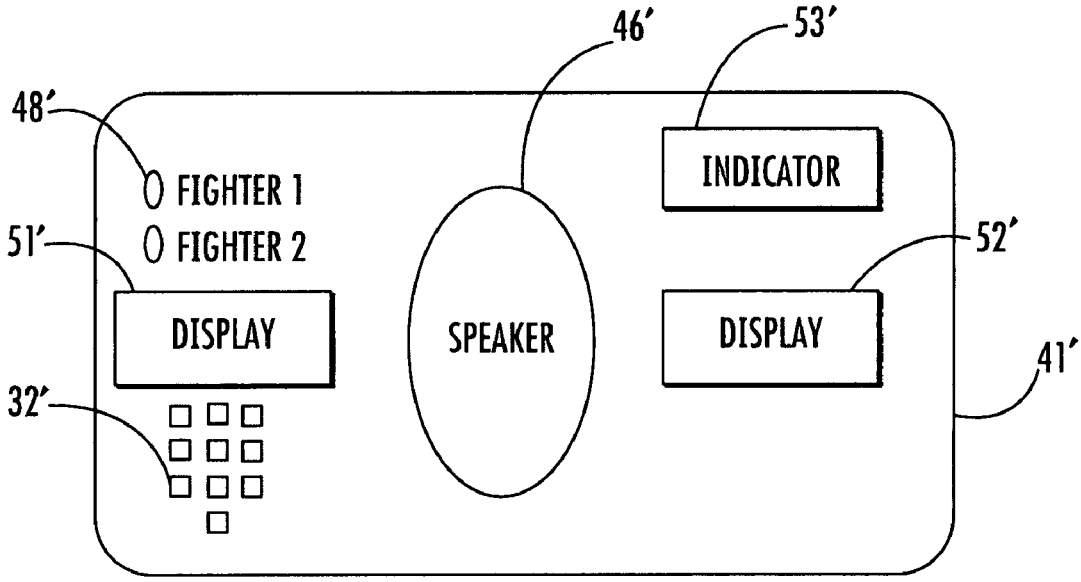
FIGS. 3A and 3B are front and rear views of the controller housing of the boxing device of FIG. 1.
Figure 3B:
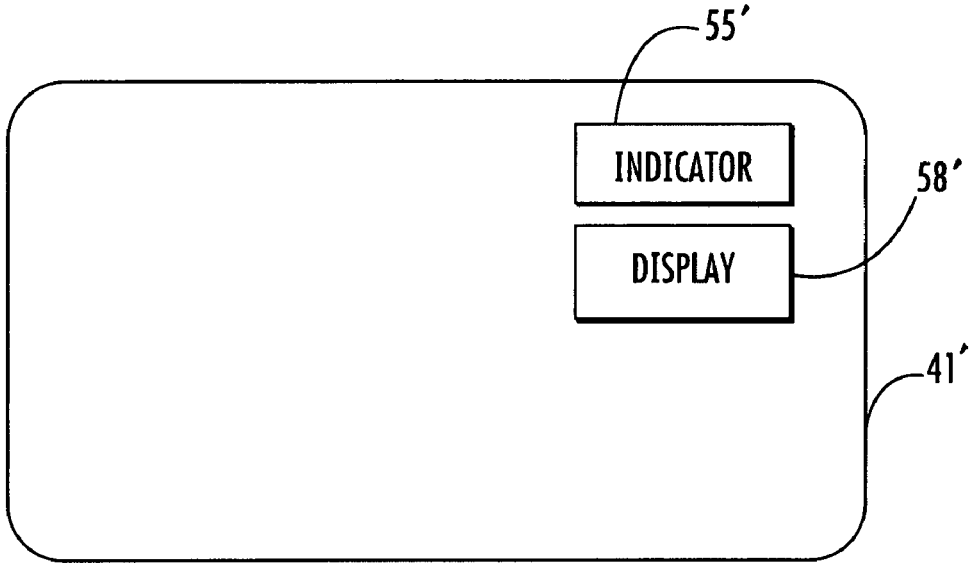

The controller housing 41' is shown in greater detail from the front side in FIG. 3A and from the back side in FIG. 3B. A speaker 46' may be carried on the front side of the housing 41' or elsewhere, as well as one or more displays 51', 52' and 58' for providing audible information to the user 38'. By way of example, the display 51' may be a liquid crystal display (LCD) for displaying program information or options, such as: aerobic mode; number of users (i.e., user mode); bag mode (i.e., single or multi-sided); user skill level (beginner, intermediate, advanced, etc.); number/length of rounds; weight of fighters for a "pound for pound" match; etc. Moreover, the display 52' may similarly be an LCD for displaying scoring or performance information, for example. The information provided by the display 52' may include calories expended in an aerobic mode, rounds of the fight in fight mode, time elapsed in the boxing session or round, punches thrown/landed, score, accuracy and/or power of impacts or other information.

The controller 40 may be implemented with hardware (e.g., processor/microprocessor, memory, etc.) and/or software components carried within the housing 41', as will be appreciated by those skilled in the art. An indicator light(s) 53' may also be carried by the housing 41' on the front and/or rear side thereof and coupled to the controller 40 to provide other information to the user, such as to signal which side of the bag is available for scoring, etc., such as during multi-user boxing sessions, for example. These indicator lights 53' and 55' may be used, for example, to indicate which user 38 should be delivering impacts to the impact sensor 36 or sensors.

In the illustrated example, the user input device 32' is a keypad carried by the controller housing 41', but it should be noted that other suitable input devices (e.g., microphone for voice input, etc.) may also be used. Moreover, the user input device(s) 32' may also be remotely located from the housing. Other indicators may also be carried by the housing 41', such as a fighter or other user 38 indicator 48' to indicate the user who should be providing input, or which user's information is being displayed, for example. Various combinations of the above-noted indicators/components, as well as other indicators/components, may be used in different embodiments, and all of the above-described indicators/components need not be used in all embodiments, as will be appreciated by those skilled in the art.

Figure 4A:
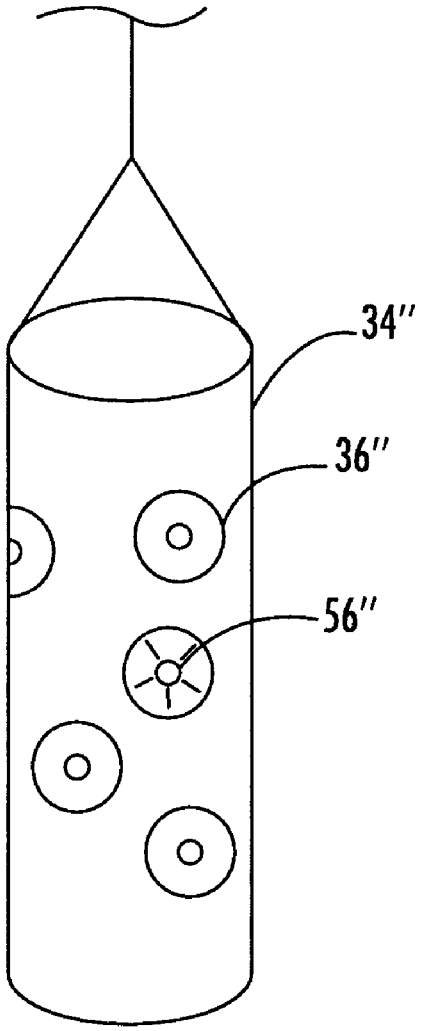
FIGS. 4A and 4B are perspective views showing alternative embodiments of the boxing device of FIG. 1.

FIG. 4 illustrates other features that may be included in the boxing device. As shown in FIG. 4A, the substrate 34" may include a visual strike indicator 56" such as a light emitting diode ("LED") or other light source to indicate which impact sensor 36" should be punched, kicked or otherwise impacted. The visual strike indicator 56" may be a single indicator or a series of indicators for a single user 38" or for two or more users. Other light placements are also possible, such as on top of the device 30', for example, which may be useful in embodiments with a remotely located controller 40. In other embodiments, audible queues could be given to the user(s) to strike a particular impact sensor 36" (e.g., "uppercut" to indicate striking upper sensor, "body blow" to indicate striking middle sensor(s), etc.). The visual strike indicator 56" is turned on and off by the controller 40 which preferably tracks the time between illumination of the visual strike indicator and impact to the impact sensor 36". This information may advantageously be used to predict or estimate a user reaction speed and or punch/kick speed of the user. This information may also be weighted based upon the personal characteristic data of the user.

Figure 4B:
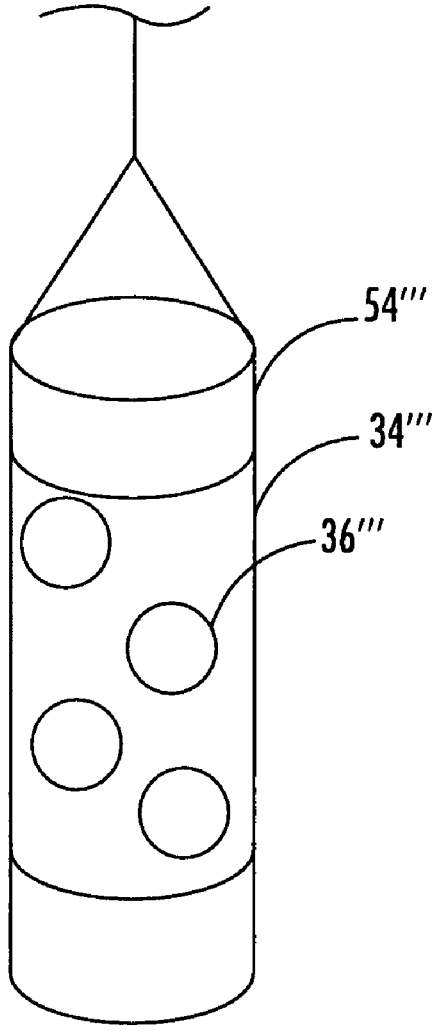

The substrate 34" may be the punching bag (or other object) as shown in FIG. 4A, or it may be a removable cover that fits on an existing punching bag 54'", etc., as seen in FIG. 4B. In this way, the substrate 34'" (i.e., the cover) may advantageously be used to convert or retrofit preexisting boxing equipment into a boxing device according to the present invention. Although the cover is shown carried by a heavy bag, the cover may also be positioned on other types of punching bags or objects (e.g., mannequins, etc.), as will be appreciated by those skilled in the art.

Figure 5:
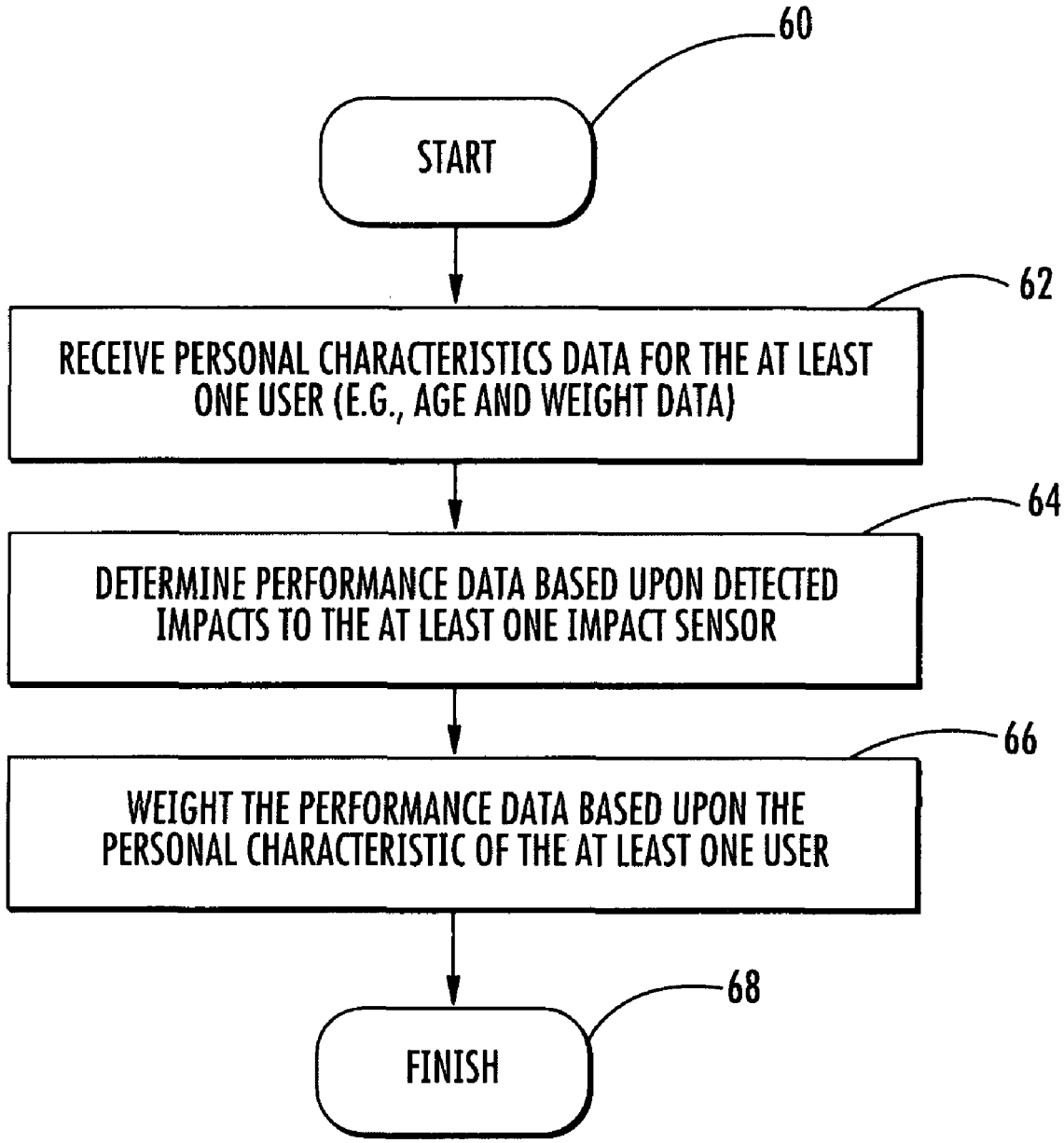
FIGS. 5 and 6 are flow diagrams illustrating methods for using a boxing device according to the present invention.

FIG. 5 illustrates a method of using a boxing device which begins at Block 60 and then proceeds to receiving personal characteristic data, such as age or weight data for at least one user (Block 62). This personal characteristic data is obtained using the user input device 32, which is communicated to the controller 40. After the personal characteristic data is received, performance data is determined based upon detected impacts to the at least one impact sensor 36 (Block 64). The performance data is then weighted based upon the personal characteristic at Block 66, as discussed further above, thus concluding the illustrated method (Block 68).

In particular, the performance data is weighted based upon the personal characteristic (e.g., age, weight, etc.) to provide the user with a more accurate assessment of the physical activity level achieved, or to "handicap" multi-user modes to make a "fair fight." For example, a user's caloric burn rate may vary depending upon the weight of the user and the amount of force applied by the user. That is, if two users of significantly different weights hit the sensor with the same amount of force, it may be assumed that the lighter of the users is exerting more energy and therefore burning more calories, for example, and the number of "burned" calories shown to the user may therefore be adjusted accordingly. In a multi-user 38 mode example, the impact from a lighter user may be "scaled up" to a corresponding level to that of the heavier user to make the scoring more equivalent, for example. Other weighting approaches for the performance data may also be used, as will be appreciated by those skilled in the art.

Figure 6:
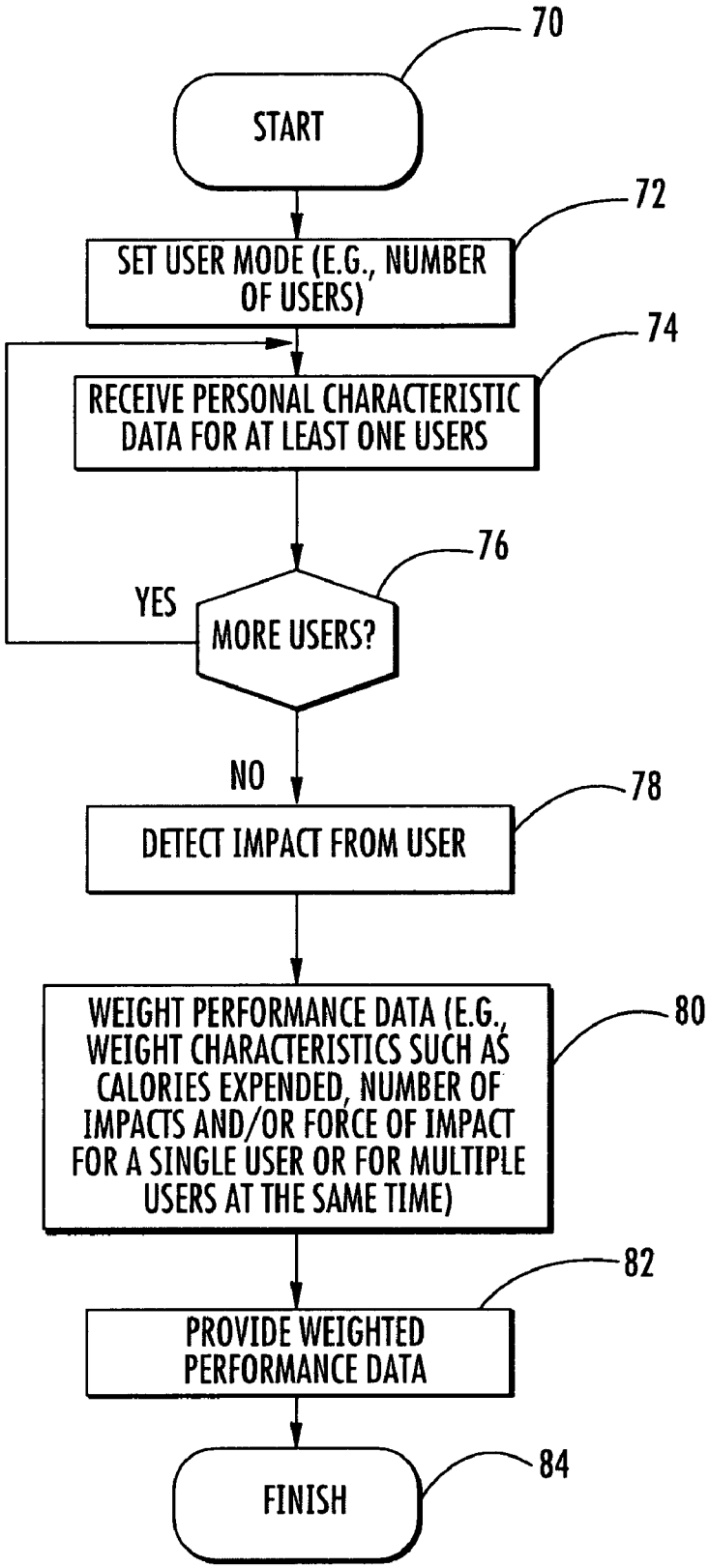

Additional method aspects are now further described with reference to FIG. 6. The method begins at (Block 70) and then proceeds to setting the user mode (Block 72). Here the controller 40 determines whether the user has indicated that the boxing session will be a single user or multi-user session, and may also include determining other user-selected options such as aerobic or fight mode, and/or whether a multi-user game will rank or weight scores or other performance data of the users 38 against each other. Setting the player mode may also involve determining what type of performance data will be provided at the end of the boxing session.

After the user mode is determined, then personal characteristic data is received for the user(s) 38 (Blocks 74, 76). Once personal characteristic data has been received for all users, the session commences and the controller 40 cooperates with the impact sensor(s) 36 to detect impacts from the user(s) 38 (Block 78).

It should be noted that for multi-user modes, either a single substrate 34 (e.g., front and back of a heavy bag), or separate substrates (e.g., separate heavy bags connected to a same controller), may be used for each user. Separate substrates 34 may be preferable where a bag, etc., is prone to move significantly following user 38 impact, such as an embodiment where the substrate hangs from a ceiling as shown in FIG. 2.

Once performance data is determined for one or more users 38, the performance data (e.g., scores, calories burned, etc.) is advantageously weighted for the user or users (Block 80). Once the performance data is weighted, the weighted performance data is then provided for one or more users 38 via the indicator 52', speaker 46', etc., at Block 82, after which the method illustratively terminates (Block 84). Of course, during an actual session the controller 40 may continue to provide updated weighted performance data, as will be appreciated by those skilled in the art.

One advantageous aspect of the present invention is the way in which it allows fighters or other users 38 to test their relative skill in a substitute fight without requiring each user to actually punch or kick the other. Instead, the impacts are received by one or more impact sensors 36 of the present invention and the impacts sensors and personal characteristic data are used to provide performance data that can determine a "winner" (e.g., the user with superior performance data).

The boxing session may be conducted as a competitive match or fight in which each user 38 punches, kicks or provides other impacts to the impact sensor(s) 36 during each round of the match, and may also be conducted as an aerobic workout in which performance data is provided but there is no winner of the fight. In fight mode, the controller 40 preferably records the user 38 impact data and, where boxing rounds are used, also determines the duration of each round. As used herein, boxing is generally meant to include boxing and/or kickboxing moves, i.e., it may include punching, kicking, kneeing, elbowing, forearming, etc., as will be appreciated by those skilled in the art.

The boxing session may be conducted in fight mode with each fighter punching or kicking a separate substrate 34, with each fighter punching or kicking the same substrate at the same time (i.e., simultaneously), or with each fighter punching or kicking the same substrate in alternating turns. Where the fighters or other users 38 alternate, the first fighter may, for example, provide impacts to the substrate 34 for a three minute time (or other time) interval of the boxing round, and the second fighter then provides impacts for the same length of time.

Where one fighter outpunches the other by a significant margin in fight mode, there may be a potential knock out ("KO") signal alerting the fighter that he is on the ropes (i.e., in danger of losing the fight). For example, the KO can occur with 2 or 3 consecutive lopsided rounds. There may be a difficult footwork mode, requiring the user 38 to move around the bag often. There may also be a low score/penalty for not going to the body (mid section of the bag). There may also be a deduction for a low blow when impacts are detected in the low blow impact sensor 37 area. The length of rounds or other boxing sessions may be changed as desired, preferably with 1 minute rounds to 3 minute rounds, although other time intervals may also be used.

The punching bag or other substrate 34 can also be used by one person in fight mode to simulate a substitute boxing match without an opponent where the fighter or other user 38 attempts to accumulate a high score. In an aerobic, non-competitive boxing session, all of the impact sensors 36 may score and accumulate hits without any requirement to hit hard (i.e., at a threshold level) or hit particular impact sensors 36. However, scoring or other performance data may be made available for both fight mode and aerobic activity mode.

The speaker 46 or display 51 and/or 52 may be used in fight mode to provide a variety of information to the user 38. For example, there may be different sounds to indicate low blows, time period to work around the other side of bag or to give some indication of how the round is going. Different sounds may indicate hard impacts, accurate impacts and rapid series of impacts, and may also indicate extra points for quick upper and lower hits on the bag or other more difficult combinations of impacts. With the accumulation of a high score by successive or hard hits the sound of 'umphh' may indicate a successful round. Also, for a low blow, the controller 40 may cause the speaker 46 to sound a groan. There may be a light and/or sound signal for the footwork requirement when it is time to work on the other side of the bag. There may also be an option for sound or no sound.

As noted above, visual strike indicators 56" may be used to force the user 38 to move around the bag or other substrate 34" to encourage footwork. The time for moving around the bag may be signaled by a light, a sound or a light and sound. The number of times the fighter moves around the bag may vary. Movement of 2-10 times per round, with some quick time periods sending fighters quickly around the bag to score may be used to simulate a realistic boxing match. Forcing the user 38 to move around the bag allows footwork to become part of the fight, producing a more realistic fight and simulating the exhausting effort of fighting a moving target. For punching bags or other substrates 34 where 360-degree access is not possible, there may be an option to score the entire fight or other boxing session on one side of the bag.

In fighting mode, points are preferably accumulated by hitting the target impact sensor 36 areas relatively hard, accurately and quickly. The score or other performance data may be adjusted to provide no points for hitting areas that are not designed to receive impacts (e.g., areas outside the circular impact sensor 36 areas shown in FIGS. 1, 2 and 4), simulating that these punches missed the desired spot and were in effect "blocked" by the imaginary opponent. Bonus points may be awarded for combining upper and lower hits on the bag within a quick time period. When fighters are required to move to the other side of the bag, scoring may be allowed on both sides of the bag with, for example, 6-8 seconds of scoring on the opposite of the bag followed by a transition back to the previous side of the bag. The light indicator may then flash and/or a warning sound may be used to alert the fighter to move to the other side of bag.

The fight or other boxing session may take personal characteristic data of the user 38 into account to weight the scores for the boxing session. If this option is employed, fighters or other users 38 may compete in a "pound per pound" bout while taking into account the relative size of fighters when calculating scores. For example, this allows the greater force or speed of impact from an older or heavier fighter to be given a lower score than the impacts from a lighter or younger fighter. A heavyweight fighter could then compete in a closely contested match with a welterweight or featherweight fighter where the force of impact from the heavyweight fighter receives a lower score (or the force of impact from the lighter fighter receives a higher score) than the same impact from the welterweight or featherweight fighter.

The impact sensor 36 may be insulated wire sensors either buried or on the surface of the substrate 34, or other types of sensors as will be appreciated by those skilled in the art. By way of example, such sensors may include one or more of accelerometers, dynamometers, magnetic-based sensors, optical-based sensors, or other suitable sensors, or a combination thereof.

That which is claimed is:

1. A method for using a multi-user boxing device comprising at least one substrate, a user input device for receiving respective weights for each of a plurality of users, at least one feedback device, and a plurality of impact sensors carried by the at least one substrate, the method comprising:

initiating a simultaneous multi-user competitive boxing match mode for the plurality of users based upon the user input device by assigning at least one respective impact sensor from among the plurality of impact sensors for each user;

determining respective performance data for each user based upon detected impacts from the users on the impact sensors during the simultaneous user competitive boxing match mode;

equating the performance data for the plurality of users to a comparative level based upon respective weights of each of the users; and providing feedback to the plurality of users via the at least one feedback device based upon the equated performance data.

2. The method of claim 1 wherein the at least one impact sensor comprises a respective set of impact sensors for each user.

3. The method of claim 1 wherein the multi-user boxing device further comprises a respective visual strike indicator carried by the substrate for each of the impact sensors; and further comprising causing the visual strike indicators to provide a visual indication for queuing the users to strike the impact sensors.

4. The method of claim 1 wherein the performance data is based upon a number of calories expended by respective users.

5. The method of claim 1 wherein the performance data is based upon a number of impacts to the impact sensors.

6. A method for using a multi-user boxing device comprising at least one substrate, a user input device for receiving respective weights for each of a plurality of users, at least one feedback device, and a plurality of impact sensors carried by the at least one substrate, the method comprising:

initiating a simultaneous multi-user competitive boxing match mode for the plurality of users based upon the user input device by assigning at least one respective impact sensor from among the plurality of impact sensors for each user;

determining respective performance data for each user based upon detected impacts from the users on the impact sensors during the simultaneous user competitive boxing match mode;

equating the performance data for the plurality of users to a comparative level based upon respective age data for each of the users; and providing feedback to the plurality of users via the at least one feedback device based upon the equated performance data.

7. The method of claim 6 wherein the at least one impact sensor comprises a respective set of impact sensors for each user.

8. The method of claim 6 wherein the multi-user boxing device further comprises a respective visual strike indicator carried by the substrate for each of the impact sensors; and further comprising causing the visual strike indicators to provide a visual indication for queuing the users to strike the impact sensors.

9. The method of claim 6 wherein the performance data is based upon a number of calories expended by respective users.

10. The method of claim 6 wherein the performance data is based upon a number of impacts to the impact sensors.

* * * * *